US010076905B2

(12) United States Patent
Fricke et al.

(10) Patent No.: US 10,076,905 B2
(45) **Date of Patent: *Sep. 18, 2018**

(54) PIEZOELECTRIC PRINTHEAD ASSEMBLY

(71) Applicant: HEWLETT-PACKARD DEVELOPMENT COMPANY, L.P., Houston, TX (US)

(72) Inventors: Peter J. Fricke, Corvallis, OR (US); Andrew L. Van Brocklin, Corvallis, OR (US)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/709,067

(22) Filed: Sep. 19, 2017

(65) Prior Publication Data

US 2018/0001637 A1 Jan. 4, 2018

Related U.S. Application Data

(63) Continuation of application No. 15/307,091, filed as application No. PCT/US2014/036005 on Apr. 30, 2014, now Pat. No. 9,776,404.

(51) Int. Cl.
*B41J 2/14* (2006.01)
*B41J 2/155* (2006.01)

(52) U.S. Cl.
CPC ..... *B41J 2/14201* (2013.01); *B41J 2/14072* (2013.01); *B41J 2/155* (2013.01); *B41J 2202/20* (2013.01)

(58) Field of Classification Search
CPC .... B41J 2/14072; B41J 2/155; B41J 2/14201; B41J 2/04541; B41J 2/04543; B41J 2/04546; B41J 2/04558; B41J 2/04561; B41J 2/04573; B41J 2/04581; B41J 2/0459; B41J 2202/19–2202/21
See application file for complete search history.

(56) References Cited

U.S. PATENT DOCUMENTS

| | | | |
|---|---|---|---|
| 6,652,074 B2 | 11/2003 | Silverbrook | |
| 7,771,032 B2 | 8/2010 | Silverbrook | |
| 7,794,047 B2 | 9/2010 | Drake et al. | |
| 8,388,112 B2 | 3/2013 | Cheng et al. | |
| 9,776,404 B2 * | 10/2017 | Fricke | B41J 2/14072 |

(Continued)

FOREIGN PATENT DOCUMENTS

| | | |
|---|---|---|
| JP | H03175044 | 7/1991 |
| JP | 2003-200574 | 7/2003 |

(Continued)

OTHER PUBLICATIONS

US 8,100,493, 01/2012, Oshima (withdrawn)

(Continued)

*Primary Examiner* — Juanita D Jackson
(74) *Attorney, Agent, or Firm* — HP Inc. Patent Department

(57) ABSTRACT

In some examples, a piezoelectric printhead assembly can include a plurality of piezoelectric micro-electro mechanical system (MEMS) dies, and application-specific integrated circuit (ASIC) dies electrically connected to the piezoelectric MEMS dies.

20 Claims, 4 Drawing Sheets

(56) References Cited

U.S. PATENT DOCUMENTS

| | | | |
|---|---|---|---|
| 2008/0218556 | A1 | 9/2008 | Seto et al. |
| 2009/0051733 | A1 | 2/2009 | Drake et al. |
| 2010/0214359 | A1 | 8/2010 | Von Essen et al. |
| 2014/0063132 | A1 | 3/2014 | Scheffelin et al. |
| 2014/0327713 | A1 | 11/2014 | Van Brocklin |

FOREIGN PATENT DOCUMENTS

| | | |
|---|---|---|
| JP | 2012-144043 | 8/2012 |
| JP | 2014-069459 | 4/2014 |
| WO | WO-2013/002775 | 1/2013 |
| WO | WO-2013002774 | 1/2013 |
| WO | WO-2013076510 | 5/2013 |
| WO | WO-2013165335 | 11/2013 |

OTHER PUBLICATIONS

Kim et al, Development of Inkjet Nozzle Driven by Double Piezo Actuators; 15th International Symposium on Flow Visualization; Jun. 25-28, 2012, pp. 1-7.

Korean Intellectual Property Office, International Searth Report and Written Opinion for Appl. No. PCT/US2014/036005 dated Jan. 30, 2015 (13 pages).

* cited by examiner

PIEZOELECTRIC PRINTHEAD ASSEMBLY

CROSS REFERENCE TO RELATED APPLICATIONS

This is a continuation of U.S. application Ser. No. 15/307,091, now issued U.S. Pat. No. 9,776,404 B2, having a national entry date of Oct. 27, 2016, which is a national stage application under 35 U.S.C. § 371 of PCT/US2014/036005, filed Apr. 30, 2014, which are both hereby incorporated by reference in their entirety.

BACKGROUND

Fluid-jet printing devices can eject fluid onto media, such as paper. The fluid can be ejected in accordance with a desired image to be formed on the media. Different fluid-jet technologies include piezoelectric and thermal inkjet technologies. Piezoelectric printing devices employ membranes that deform when electric energy is applied. The membrane deformation causes ejection of fluid. Thermal inkjet printing technologies, by comparison, employ heating resistors that are heated when electric energy is applied. The heating causes ejection of the fluid.

DETAILED DESCRIPTION

Examples of the present disclosure provide piezoelectric printhead assemblies and methods. The piezoelectric printhead assemblies disclosed herein can help to provide a reduced print zone, as compared to other piezoelectric printhead systems, among other advantages. The reduced print zone, e.g., a narrow print zone, can help provide for improved ink drop accuracy, thus providing improved image quality and/or enabling greater print speeds, as compared to other piezoelectric printhead systems.

Piezoelectric printing is a form of drop-on-demand printing where a drop of fluid, e.g. a drop of ink, is ejected from a nozzle of a die when an actuation pulse is provided for that nozzle. For piezoelectric printing an electrical drive voltage, e.g., the actuation pulse, is provided to a piezoelectric material of the die, which deforms to eject the drop from the nozzle.

Figure 1:
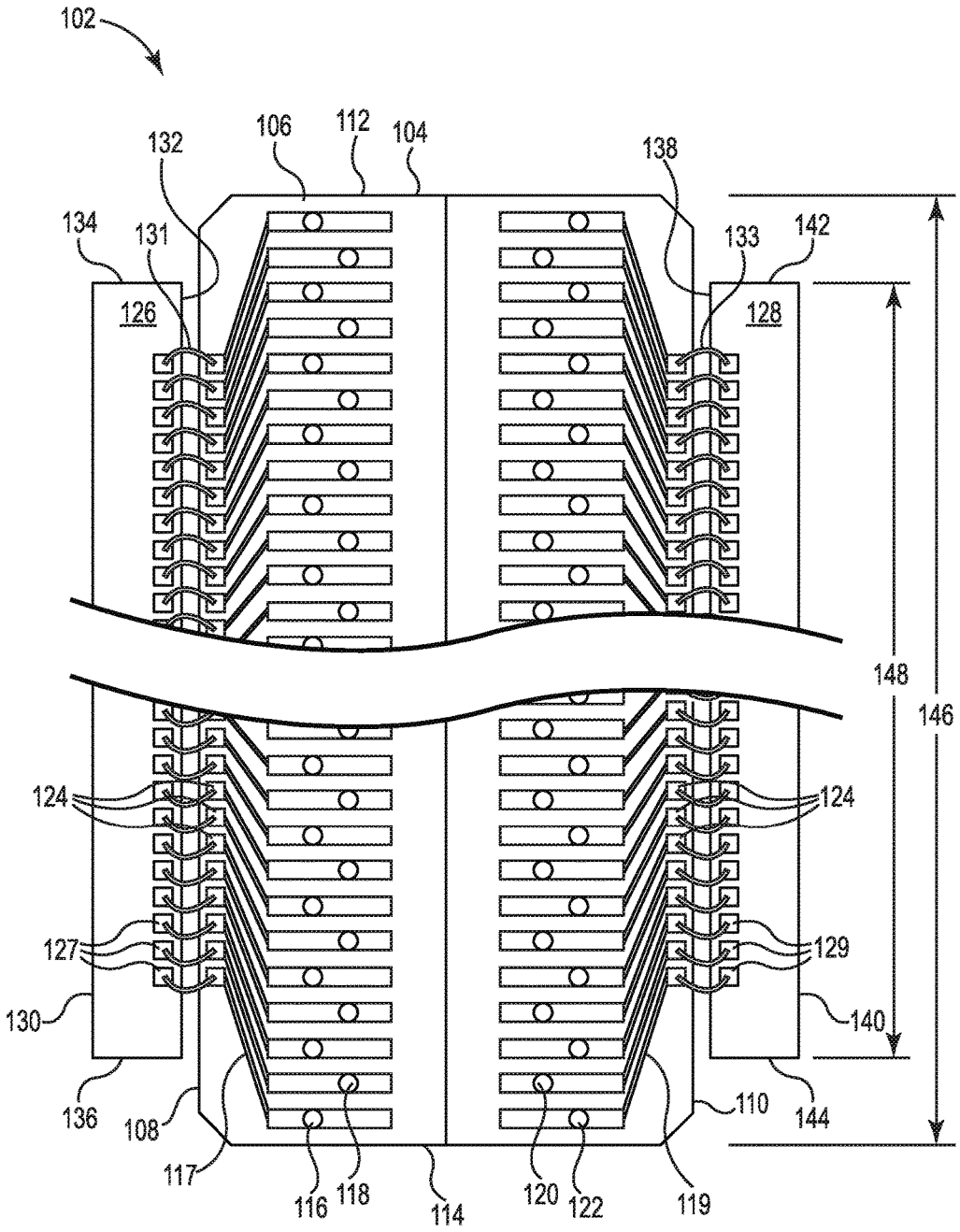
FIG. 1 illustrates a portion of a piezoelectric printhead assembly in accordance with one or more examples of the present disclosure.

FIG. 1 illustrates a portion of a piezoelectric printhead assembly 102 in accordance with one or more examples of the present disclosure. The printhead assembly 102 can include a piezoelectric micro-electro mechanical system (MEMS) die 104, which may also be referred to as a piezoelectric printhead die.

The piezoelectric MEMS die 104 can include a shooting face 106, a first longitudinal side 108, a second longitudinal side 110, a first crosswise side 112, and a second crosswise side 114. The MEMS die 104 can include a number of columns of nozzles, e.g., located in the shooting face 106.

For instance, the piezoelectric MEMS die 104 can include a first column 116 of nozzles, a second column 118 of nozzles, a third column 120 of nozzles, and a fourth column 122 of nozzles; however examples of the present disclosure are not so limited. Each particular nozzle can have a number of piezoelectric materials associated therewith. For instance, a number of actuation pulses may be provided to a number of piezoelectric materials to eject a drop from a particular nozzle. Some examples of the present disclosure provide that the nozzles of the MEMS die 104 can be on a nozzle pitch in a range from 20 micrometers to 200 micrometers. As an example, some examples of the present disclosure provide that the nozzles of the MEMS die 104 can be on a nozzle pitch in a range from 40 micrometers to 45 micrometers.

The piezoelectric MEMS die 104 can include a number of wirebond pads 124. As illustrated in FIG. 1, a portion of the wirebond pads 124 can be located proximate, e.g., close, to the first longitudinal side 108 and another portion of the wirebond pads 124 can be located proximate to the second longitudinal side 110. However, examples of the present disclosure are not so limited. The wirebond pads 124 can be utilized to form a plurality of wirebonds to couple the MEMS die 104 to a number of application-specific integrated circuit (ASIC) dies.

The piezoelectric printhead assembly 102 can include a number of ASIC dies. As illustrated in FIG. 1, some examples of the present disclosure provide that the piezoelectric printhead assembly 102 includes a first ASIC die 126 and/or a second ASIC die 128. Some examples of the present disclosure provide that the first ASIC die 126 and the second ASIC die 128 have a single design. For instance, the first ASIC die 126 and the second ASIC die 128 can have the same configuration, e.g., prior to ASIC dies 126 and 128 being coupled to piezoelectric MEMS die 104. As such, advantageously a single type of ASIC die can be fabricated for the piezoelectric printhead assembly 102. The first ASIC die 126 can include a number of wirebond pads 127. The wirebond pads 127 can be utilized to form a plurality of wirebonds 131 to couple the MEMS die 104 to the first ASIC die 126. The second ASIC die 128 can include a number of wirebond pads 129. The wirebond pads 129 can be utilized to form a plurality of wirebonds 133 to couple the MEMS die 104 to the second ASIC die 128. Some examples of the present disclosure provide that the wirebond pads can have a wirebond pad pitch in a range from 32 micrometers to 36 micrometers. Wirebond pad pitch can be defined as a distance from the center of a first wirebond pad to the center of a second wirebond pad, where the second wirebond pad immediately follows the first wirebond pad, e.g., the first and second wirebond pads are consecutive.

The wires utilized for wire bonds 131 and wire bonds 133 can include a metal such as gold, copper, aluminum, silver, palladium, or alloys thereof, among others. The wires utilized for wire bonds 131 and wire bonds 133 can have a diameter in a range from 10 microns to 200 microns. Forming the wire bonds 131 and the wire bonds 133 can include ball bonding, wedge bonding, compliant bonding, or combinations thereof, among others.

Utilizing the wire bonds 131 and the wire bonds 133 to respectively couple the first ASIC die 126 and the second ASIC die 128 to the piezoelectric MEMS die 104 can help to provide an increased nozzle density. For instance, some examples of the present disclosure provide that the piezoelectric MEMS die 104 has a nozzle density of 1200 nozzles per inch; however, examples of the present disclosure are not so limited. Flex interconnects, utilized in other piezoelectric printing systems, are unable meet the interconnect density of some examples of the present disclosure, which, as mentioned, utilize wire bonds.

The first ASIC die 126 can include a, first longitudinal side 130, a second longitudinal side 132, a first crosswise side 134, and a second crosswise side 136. Similarly, the second ASIC die 128 can include a, first longitudinal side 138, a second longitudinal side 140, a first crosswise side 142, and a second crosswise side 144.

Some examples of the present disclosure provide that the first ASIC die 126 can control firing, e.g., ejection of fluid from, of nozzles in the first column of nozzles 116 and the second column of nozzles 118. Similarly, some examples of the present disclosure provide that the second ASIC die 128 can control firing of nozzles in the third column of nozzles 120 and the fourth column of nozzles 122. Each of the ASIC dies 126 and 128 can respectively include components that may be utilized for controlling the firing of nozzles including, but not limited to, a number of arbitrary drive waveform data generators, a waveform selector, a waveform scaler, a waveform conditioner, a control sequencer, a number of digital-to-analog converters, and a number of driver amplifiers, among others.

As illustrated in FIG. 1, the piezoelectric MEMS die 104 can have a longitudinal length 146 and the first ASIC die 126 and the second ASIC die 128 can have an ASIC longitudinal length 148. Some examples of the present disclosure provide that the piezoelectric MEMS die longitudinal length 146 is greater than the ASIC longitudinal length 148. For instance, the ASIC longitudinal length 148 can have a value in a range from seventy-five percent to eighty-five percent of the piezoelectric MEMS die longitudinal length 146. Because the piezoelectric MEMS die longitudinal length 146 is greater than the ASIC longitudinal length 148, a reduced print zone, as compared to other piezoelectric printhead systems, can be provided by interlocking a number of piezoelectric printhead assemblies 102 as discussed further herein. The reduced print zone can help provide for improved ink drop accuracy, thus providing improved image quality and/or enabling greater print speeds, as compared to other piezoelectric printhead systems.

As mentioned, a plurality of wirebonds 131, e.g., wirebonds between a portion of wirebond pads 124 and wirebond pads 127, can be utilized to couple the MEMS die 104 to the first ASIC die 126 and a plurality of wirebonds 133, e.g., wirebonds between a portion of wirebond pads 124 and wirebond pads 129, can be utilized to couple the MEMS die 104 to the second ASIC die 128. Some examples of the present disclosure provide that the portion of wirebond pads 124, which couple the MEMS die 104 to the first ASIC die 126, can be respectively coupled to nozzles in the first column 116 and the second column 118 by a plurality of interconnects 117, e.g., a plurality of traces. For instance, a particular interconnect 117 can be coupled to a first nozzle in the first column 116, an immediately subsequent interconnect 117 can be coupled to a nozzle in the second column 118, and a next immediately subsequent interconnect 117 can be coupled to a second nozzle in the first column 116, e.g., where the second nozzle is immediately subsequent to the first nozzle in the first column 116, and so forth. Similarly, the portion of wirebond pads 124, which couple the MEMS die 104 to the second ASIC die 128, can be respectively coupled to nozzles in the third column 120 and the fourth column 122 by a plurality of interconnects 119.

Some examples of the present discourse provide that the interconnects 117 and/or the interconnects 119 have an interconnect pitch reduction, e.g., a reduction from a wider interconnect pitch to a narrower interconnect pitch. Interconnect pitch can be defined as a distance from the center of a first interconnect to the center of a second interconnect, where the second interconnect immediately follows the first interconnect, e.g., the first and second interconnects are consecutive. For instance, where the interconnects 117 and 119 are respectively coupled to nozzles in columns 116, 118, 120, and 122, the interconnects 117 and 119 can have a interconnect pitch value, e.g., a first interconnect pitch value, in a range from 20 micrometers to 200 micrometers, e.g., the first interconnect pitch value is equal to a nozzle pitch value. However, the interconnects 117 and 119 respectively converge, e.g. the interconnect pitch is reduced, as the interconnects 117 and 119 respectively approach the wirebond pads 127 and 129. Where the interconnects 117 and 119 are respectively coupled to wirebond pads 127 and 129, the interconnects 117 and 119 can have a reduced interconnect pitch value in a range from 32 micrometers to 36 micrometers, e.g., a reduced interconnect pitch value that is equal to the wirebond pad pitch value. The reduced interconnect pitch can be utilized because the piezoelectric MEMS die longitudinal length 146 is greater than the ASIC longitudinal length 148. The interconnect pitch value reduction can be ten to seventy percent.

Figure 2:
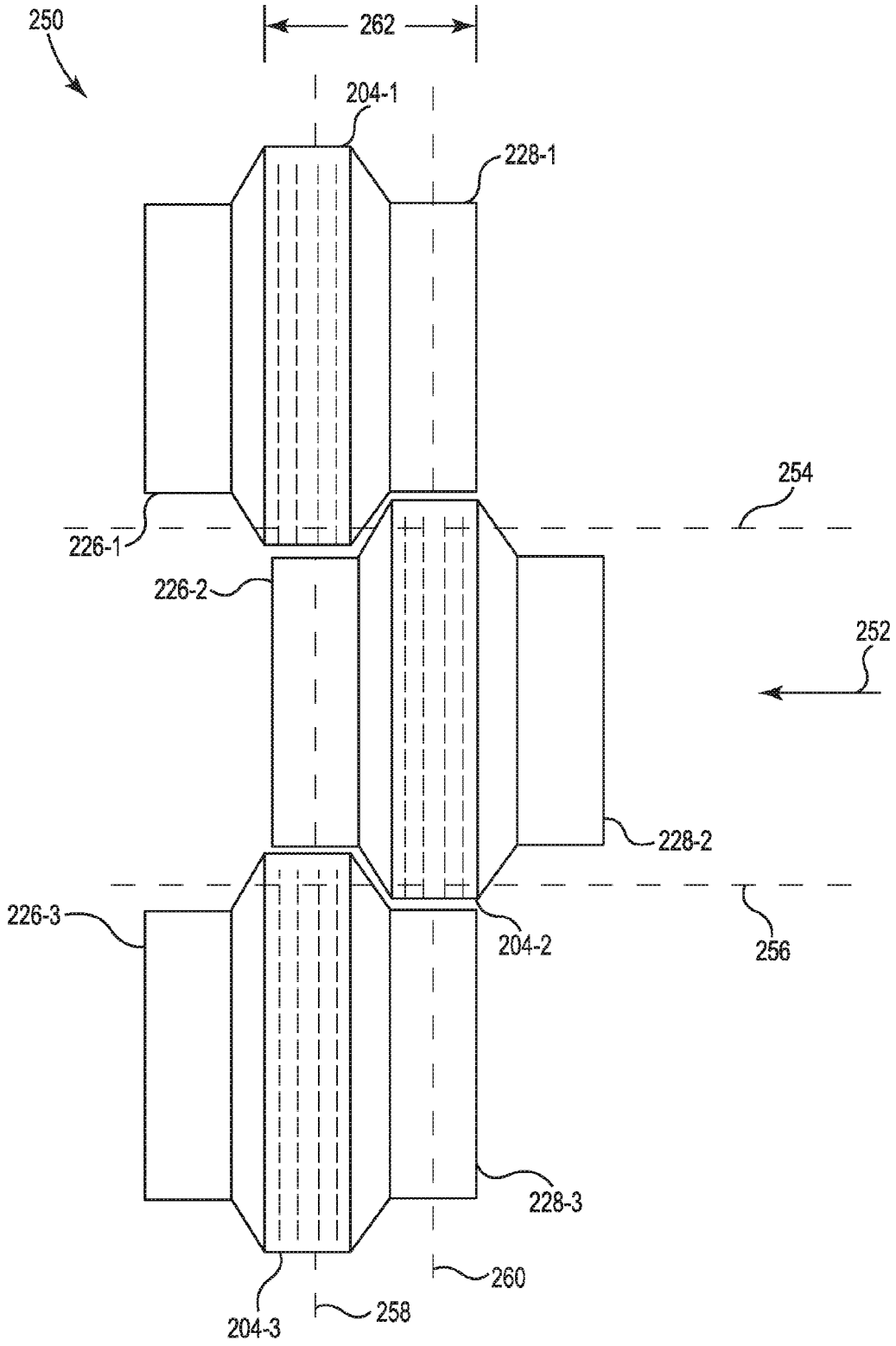
FIG. 2 illustrates a portion of a piezoelectric printhead assembly in accordance with one or more examples of the present disclosure.

FIG. 2 illustrates a portion of a piezoelectric printhead assembly 250 in accordance with one or more examples of the present disclosure. The printhead assembly can include a plurality of piezoelectric MEMS dies 204. While three piezoelectric MEMS dies, a first piezoelectric MEMS die 204-1, a second piezoelectric MEMS die 204-2, and a third piezoelectric MEMS die 204-3, are illustrated in FIG. 2, examples of the present disclosure are not so limited. As discussed, the first piezoelectric MEMS die 204-1 can include a first ASIC die 226-1 and/or a second ASIC die 228-1, the second piezoelectric MEMS die 204-2 can include a first ASIC die 226-2 and/or a second ASIC die 228-2, and the third piezoelectric MEMS die 204-3 can include a first ASIC die 226-3 and/or a second ASIC die 228-3.

Media, e.g., to be printed upon, may pass by the piezoelectric printhead assembly 250 in a direction indicated by arrow 252. As the media passes by the piezoelectric printhead assembly 250, a number of nozzles may eject fluid onto the media. As illustrated in FIG. 2, nozzles of the second piezoelectric MEMS die 204-2 can overlap nozzles of the first piezoelectric MEMS die 204-1. For instance, as illustrated in FIG. 2, there are nozzles of the second piezoelectric MEMS die 204-2 both above and below a line 254 and nozzles of the first piezoelectric MEMS die 204-1 both above and below the line 254. Similarly, nozzles of the of the second piezoelectric MEMS die 204-2 can overlap nozzles of the third piezoelectric MEMS die 204-3, as indicated by nozzles of the of the second piezoelectric MEMS die 204-2 both above and below a line 256 and nozzles of the third piezoelectric MEMS die 204-3 both above and below the line 256. When nozzles of piezoelectric MEMS dies overlap, overlapping nozzles from either or both of the piezoelectric MEMS dies may be utilized for printing to particular segments, e.g., segments passing by the overlapping nozzles, of the media.

As shown in FIG. 2, MEMS dies, which have a MEMS die longitudinal length, having a first ASIC die and a second ASIC die, each having a ASIC longitudinal length that is less than the MEMS die longitudinal length, coupled respectively thereto can be interlocked. For instance, a first ASIC die 226-2 that is coupled to a second piezoelectric MEMS die 204-2 can be located, e.g., interlocked, between a first piezoelectric MEMS die 204-1 and a third piezoelectric MEMS die 204-3.

Additionally, the second piezoelectric MEMS die 204-2 can be located, e.g., interlocked, between a second ASIC die 228-1 coupled to the first piezoelectric MEMS die 204-1 and a second ASIC die 228-3 coupled to the third piezoelectric MEMS die 204-3. As shown in FIG. 2, when interlocked, the second piezoelectric MEMS die 204-2 can be adjacent to the first piezoelectric MEMS die 204-1, the second ASIC die 228-1, the third piezoelectric MEMS die 204-3, and the third ASIC die 228-3.

As shown in FIG. 2, when interlocked, a column of nozzles of the first piezoelectric MEMS die 204-1 can form a line 258 with a column of nozzles of the third piezoelectric MEMS die 204-3. Also, the line 258 can intersect the first ASIC die 226-2. Some examples of the present disclosure provide that the line 258 does not intersect the second piezoelectric MEMS die 204-2. Some examples of the present disclosure provide that the line 258 does not intersect an ASIC die that is coupled to the either the first piezoelectric MEMS die 204-1 or the third piezoelectric MEMS die 204-3.

As shown in FIG. 2, when interlocked, a column of nozzles of the second piezoelectric MEMS die 204-2 can form a line 260 that intersects an ASIC die, e.g., ASIC die 228-1, coupled to the first piezoelectric MEMS die 204-1 and an ASIC die, e.g., ASIC die 228-3, coupled to the third piezoelectric MEMS die 204-3. Some examples of the present disclosure provide that the line 260 does not intersect either the first piezoelectric MEMS die 204-1 or the third piezoelectric MEMS die 204-3.

Interlocking the plurality of piezoelectric MEMS dies each of which is respectively coupled to a first ASIC die and a second ASIC die can help to provide a print zone 262. The print zone 262 can be defined as a linear distance that spans each column of nozzles of each piezoelectric MEMS die of the piezoelectric printhead assembly 250. Advantageously, examples of the present disclosure can provide that the print zone 262 is narrower, e.g., the linear distance that spans each column of nozzles of each piezoelectric MEMS die is shorter, as compared to print zones of other piezoelectric printhead systems. Providing the narrow print zone 262 can help to improve ink drop accuracy, thus providing improved image quality and/or enabling greater print speeds, as compared to other piezoelectric printhead systems.

Figure 3:
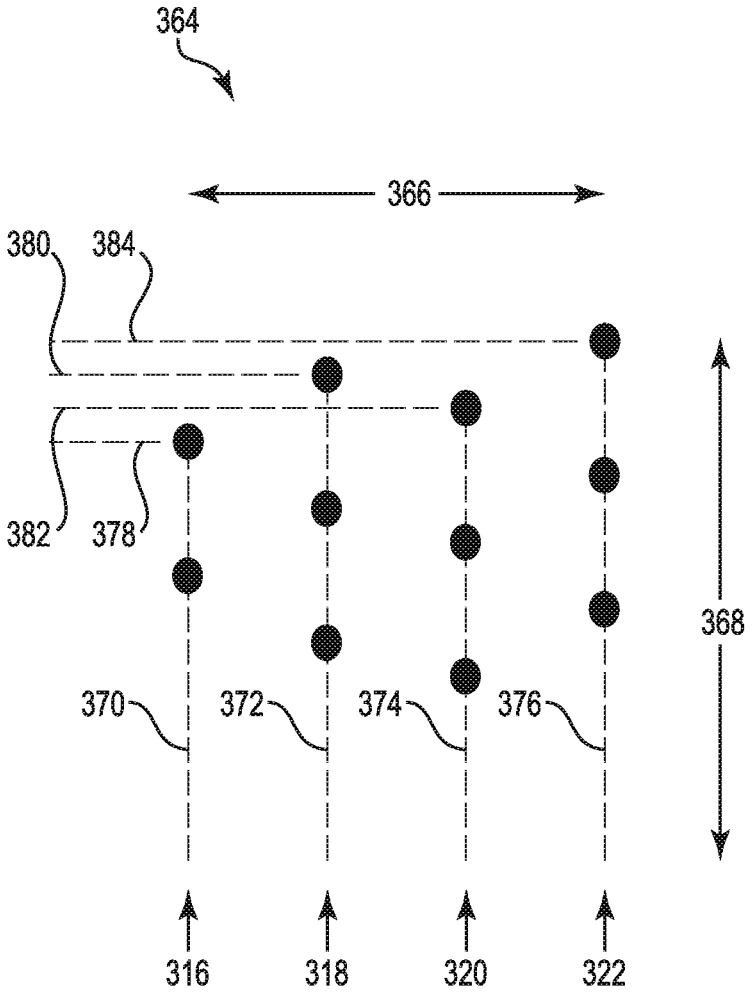
FIG. 3 illustrates a plurality nozzles in accordance with one or more examples of the present disclosure.

FIG. 3 illustrates a plurality of nozzles 364 in accordance with one or more examples of the present disclosure. The plurality of nozzles 364 can extend in a crosswise direction 366 and can extend in a longitudinal direction 368. In other words, the plurality of nozzles 364 can form a two dimensional array.

As shown in FIG. 3, nozzles in a first column 316 can be associated with a longitudinal axis 370, nozzles in a second column 318 can be associated with a longitudinal axis 372, nozzles in the a third column 320 can be associated with a longitudinal axis 374, and nozzles in a fourth column 322 can be associated with a longitudinal axis 376. Some examples of the present disclosure provide that the longitudinal axis 370 can be separated from the longitudinal axis 372 by a distance in a range from 1100 micrometers to 1350 micrometers; the longitudinal axis 372 can be separated from the longitudinal axis 374 by a distance in a range from 1450 micrometers to 1800 micrometers, and the longitudinal axis 374 can be separated from the longitudinal axis 376 by a distance in a range from 1100 micrometers to 1350 micrometers.

As shown in FIG. 3, nozzles in the first column 316 can be associated with a crosswise axis 378, nozzles in the second column 318 can be associated with a crosswise axis 380, nozzles in the third column 320 can be associated with a crosswise axis 382, and nozzles in the fourth column 322 can be associated with a crosswise axis 384. Some examples of the present disclosure provide that the crosswise axis 378 can be separated from the crosswise axis 382 by a distance in a range from 10 micrometers to 100 micrometers; the crosswise axis 380 can be separated from the crosswise axis 382 by a distance in a range from 10 micrometers to 100 micrometers, and the crosswise axis 380 can be separated from the crosswise axis 384 by a distance in a range from 10 micrometers to 100 micrometers.

As shown FIG. 3, the distance between the crosswise axis 378 and the crosswise axis 380, e.g., the nozzle pitch, can be in a range from 20 micrometers to 200 micrometers. Similarly, the distance between the crosswise axis 382 and the crosswise axis 384 can be in a range from 20 micrometers to 200 micrometers.

Some examples of the present disclosure provide that each piezoelectric MEMS die includes 1056 nozzles; however, examples of the present disclosure are not so limited. Some examples of the present disclosure provide that each respective column, e.g., each of columns 316, 318, 320, 322, include 264 nozzles; however, examples of the present disclosure are not so limited.

Figure 4:
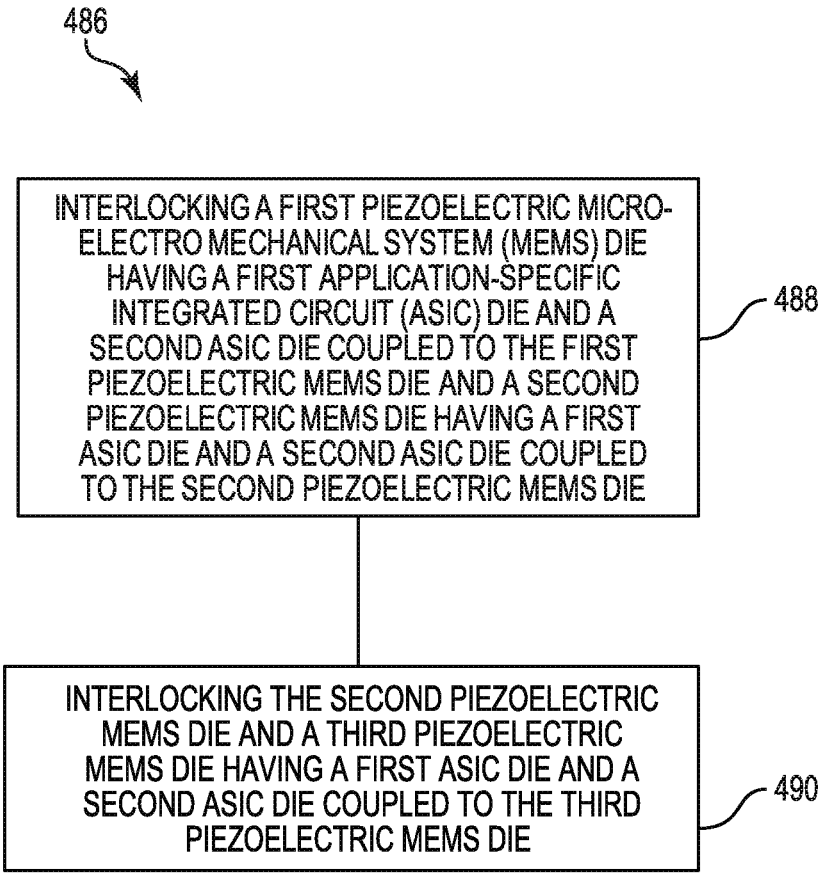
FIG. 4 illustrates a block diagram of an example of a method according to the present disclosure.

FIG. 4 illustrates a block diagram of an example of a method 486 according to the present disclosure. The method 486 can be utilized for print zone reduction, e.g., providing narrow print zone, as compared to other piezoelectric printing systems. As mentioned, a reduced print zone, as compared to other piezoelectric printhead systems, can help provide for improved ink drop accuracy, thus providing improved image quality and/or enabling greater print speeds, as compared to other piezoelectric printhead systems.

At 488, the method 486 can include interlocking a first piezoelectric MEMS die having a first ASIC die and a second ASIC die coupled to the first piezoelectric MEMS die and a second piezoelectric MEMS die having a first ASIC die and a second ASIC die coupled to the second piezoelectric MEMS die. Interlocking the piezoelectric MEMS dies can help to provide a narrow print zone, as discussed herein.

At 490, the method 486 interlocking the second piezoelectric MEMS die and a third piezoelectric MEMS die having a first ASIC die and a second ASIC die coupled to the third piezoelectric MEMS die.

Some examples of the present disclosure provide that the method 486 can include forming a line that includes a column of nozzles of the first piezoelectric MEMS die, the first ASIC die coupled to the second piezoelectric MEMS die, and a column of nozzles of the third piezoelectric MEMS die. Some examples of the present disclosure provide that the method 486 can include forming a line that includes the second ASIC die coupled to the first piezoelectric MEMS die, a column of nozzles of the second piezoelectric MEMS die, and the second ASIC die coupled to the third piezoelectric MEMS die.

The specification examples provide a description of the piezoelectric printhead assemblies and method of the present disclosure. Since many examples can be made without departing from the spirit and scope of the system and method of the present disclosure, this specification sets forth some of the many possible example configurations and implementations.

In the detailed description of the present disclosure, reference is made to the accompanying drawings that form a part hereof, and in which is shown by way of illustration how examples of the disclosure may be practiced. These examples are described in sufficient detail to enable those of ordinary skill in the art to practice the examples of this disclosure, and it is to be understood that other examples may be used and the process, electrical, and/or structural changes may be made without departing from the scope of the present disclosure.

The figures herein follow a numbering convention in which the first digit or digits correspond to the drawing figure number and the remaining digits identify an element or component in the drawing. Elements shown in the various examples herein can be added, exchanged, and/or eliminated so as to provide a number of additional examples of the present disclosure.

In addition, the proportion and the relative scale of the elements provided in the figures are intended to illustrate the examples of the present disclosure, and should not be taken in a limiting sense. As used herein, "a number of" an entity, an element, and/or feature can refer to one or more of such entities, elements, and/or features.

What is claimed:

1. A printhead assembly comprising:

a plurality of piezoelectric micro-electro mechanical system (MEMS) dies;

first application-specific integrated circuit (ASIC) dies electrically connected to a first piezoelectric MEMS die of the plurality of piezoelectric MEMS dies; and second ASIC dies electrically connected to a second piezoelectric MEMS die of the plurality of piezoelectric MEMS dies, wherein the first piezoelectric MEMS die has a longitudinal length and each of the first ASIC dies has an ASIC longitudinal length, the longitudinal length of the first piezoelectric MEMS die being greater than the ASIC longitudinal length.

2. The printhead assembly of claim 1, wherein the first piezoelectric MEMS die overlaps the second piezoelectric MEMS die along a longitudinal axis parallel to a length of each of the first and second piezoelectric MEMS dies extends.

3. The printhead assembly of claim 2, wherein the first piezoelectric MEMS die comprises nozzles that overlap nozzles of the second piezoelectric MEMS die along the longitudinal axis.

4. The printhead assembly of claim 3, wherein the first piezoelectric MEMS die is offset from the second piezoelectric MEMS die along a first axis corresponding to motion of a media for printing by the printhead assembly.

5. The printhead assembly of claim 4, wherein the nozzles of the first piezoelectric MEMS die are provided on both sides of a cross-wise line that is parallel to the first axis, and the nozzles of the second piezoelectric MEMS die are provided on both sides of the cross-wise line.

6. The printhead assembly of claim 2, wherein a longitudinal line parallel to the longitudinal axis crosses the first piezoelectric MEMS die and one of the second ASIC dies.

7. The printhead assembly of claim 1, wherein the plurality of piezoelectric MEMS dies comprise a third piezoelectric MEMS die, and the printhead assembly further comprises third ASIC dies electrically connected to the third piezoelectric MEMS die, and wherein a column of nozzles of the first piezoelectric MEMS die forms a line with a column of nozzles of the third piezoelectric MEMS die.

8. The printhead assembly of claim 7, wherein the line does not intersect the second piezoelectric MEMS die.

9. The printhead assembly of claim 8, wherein a column of nozzles of the second piezoelectric MEMS die forms a line that intersects one of the first ASIC dies and one of the third ASIC dies.

10. The printhead assembly of claim 1, wherein one of the first ASIC dies is located on a first side of the first piezoelectric MEMS die, and another one of the first ASIC dies is located on a different second side of the first piezoelectric MEMS die, and wherein one of the second ASIC dies is located on a first side of the second piezoelectric MEMS die, and another one of the second ASIC dies is located on a different second side of the second piezoelectric MEMS die.

11. The printhead assembly of claim 1, wherein each of the first ASIC dies includes wirebond pads, and the first piezoelectric MEMS die includes wirebond pads electrically connected by wirebonds to the wirebond pads of the first ASIC dies.

12. The printhead assembly of claim 11, wherein the first piezoelectric MEMS die comprises:

nozzles extending along a length of the first piezoelectric MEMS die, and interconnects to electrically connect the wirebond pads of the first piezoelectric MEMS die to the nozzles.

13. The printhead assembly of claim 12, wherein a first interconnect pitch between the interconnects at the nozzles is larger than a second interconnect pitch between the interconnects at the wirebond pads of the first piezoelectric MEMS die.

14. The printhead assembly of claim 13, wherein the second interconnect pitch is between 10% to 70% of the first interconnect pitch.

15. A printhead assembly comprising:

a plurality of piezoelectric micro-electro mechanical system (MEMS) dies, each of the plurality of piezoelectric MEMS dies comprising nozzles, wherein the nozzles of a first piezoelectric MEMS die of the plurality of piezoelectric MEMS dies overlaps with nozzles of a second piezoelectric MEMS die of the plurality of piezoelectric MEMS dies along a longitudinal axis parallel to lengths of the first and second piezoelectric MEMS dies;

a first application-specific integrated circuit (ASIC) die electrically connected to the first piezoelectric MEMS die; and a second ASIC die electrically connected to the first piezoelectric MEMS die, wherein the first piezoelectric MEMS die has a longitudinal length and each of the first ASIC die and second ASIC die has an ASIC longitudinal length, the longitudinal length of the first piezoelectric MEMS die being greater than the ASIC longitudinal length.

16. The printhead assembly of claim 15, wherein the ASIC longitudinal length is 75% to 85% of the longitudinal length of the first piezoelectric MEMS die.

17. The printhead assembly of claim 15, wherein the plurality of piezoelectric MEMS dies further includes a third piezoelectric MEMS die, wherein the first piezoelectric MEMS die is offset along a direction of motion of media from the second piezoelectric MEMS die, and the third piezoelectric MEMS die is offset along the direction of motion of media from the second piezoelectric MEMS die.

18. The printhead assembly of claim 17, wherein a line along the longitudinal length of the first piezoelectric MEMS die intersects an ASIC die electrically connected to the second piezoelectric MEMS die.

19. The printhead assembly of claim 18, wherein a line along a longitudinal length of the second piezoelectric MEMS die intersects the second ASIC die electrically connected to the first piezoelectric MEMS die.

20. The printhead assembly of claim 15, wherein the piezoelectric MEMS die comprises wirebond pads electrically connected to the first and second ASIC dies, and the wirebond pads are further electrically connected to the nozzles of the first piezoelectric MEMS die.

* * * * *